US007884928B2

(12) United States Patent
Mizuno et al.

(10) Patent No.: US 7,884,928 B2
(45) Date of Patent: Feb. 8, 2011

(54) CUP ATTACHING APPARATUS

(75) Inventors: Toshiaki Mizuno, Gamagori (JP); Yoshinori Matsuyama, Anjo (JP); Toshiro Matsumoto, Gamagori (JP); Kenji Suzuki, Toyokawa (JP); Satoshi Imaizumi, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 331 days.

(21) Appl. No.: 12/153,240

(22) Filed: May 15, 2008

(65) Prior Publication Data

US 2008/0297776 A1 Dec. 4, 2008

(30) Foreign Application Priority Data

May 31, 2007 (JP) ..... 2007-146260

(51) Int. Cl.
*G01B 9/00* (2006.01)

(52) U.S. Cl. ..... 356/124

(58) Field of Classification Search ..... None
See application file for complete search history.

(56) References Cited

U.S. PATENT DOCUMENTS 6,075,591 A 6/2000 Vokhmin
6,798,501 B1 9/2004 Mizuno

FOREIGN PATENT DOCUMENTS

| | | |
|---|---|---|
| EP | 1 739 472 A1 | 1/2005 |
| JP | A-3-113415 | 5/1991 |
| JP | A-2000-79545 | 3/2000 |
| JP | A-2002-292547 | 10/2002 |
| JP | A-2005-316436 | 11/2005 |

*Primary Examiner*—Gregory J Toatley
*Assistant Examiner*—Amanda H Merlino
(74) *Attorney, Agent, or Firm*—Oliff & Berridge, PLC

(57) ABSTRACT

A cup attaching apparatus for attaching a cup as a processing jig to an eyeglass lens including an illumination optical system including an illumination light source arranged to illuminate a side of the front surface of the lens by light from the light source; an imaging optical system including an imaging device and a retroreflection member placed on an opposite side from the light source with respect to the lens; an image processing device adapted to process an image signal from the imaging device to detect at least one of a mark point provided on a unifocal lens, a small lens portion of a bifocal lens, and a progressive mark provided on a progressive focal lens and obtain a position of the detected one; and an arithmetic control device adapted to determine an attaching position of the cup based on the position obtained by the image processing device.

8 Claims, 14 Drawing Sheets

CUP ATTACHING APPARATUS

BACKGROUND OF THE INVENTION

1. Field of the Invention

The present invention relates to a cup attaching apparatus for attaching a cup as a processing jig used for processing an eyeglass lens to a surface of the lens.

2. Description of Related Art

As a cup attaching apparatus, there is known an apparatus comprising an illumination optical system for projecting illumination light to a lens from a front surface side of the lens, a measurement index of a predetermined pattern and a screen placed at a back surface side of the lens, and an imaging optical system including an imaging device for imaging an image of the measurement index and an image of the lens projected on the screen. This apparatus is arranged to detect an optical center and a cylinder axis angle of the lens by processing an image signal from the imaging device, and determine an attaching position of the cup based on a detection result thereof (e.g., see U.S. Pat. No. 6,798,501B1 (JP2000-79545A)). Such apparatus is configured so that, for a unifocal lens or the like marked with a mark point on a lens surface (a lens front or back surface), an image of the mark point is projected onto the screen; for a bifocal lens, an image of a small lens portion is projected onto the screen; and for a progressive focal lens, an image of a mark printed on a lens surface is projected onto the screen. The image projected onto the screen is imaged by the imaging device to determine the attaching position of the cup.

Further, another apparatus has also been proposed, comprising an illumination optical system for projecting diffused illumination light onto a lens through a diffusion plate from a back surface side of the lens, and an optical system for observing or imaging, from a front surface side of the lens, an image of the lens illuminated by the diffused illumination light (see for example JP3(1991)-113415). Further, another apparatus has also been proposed, including an illumination optical system for projecting illumination light to a lens from a front surface side of the lens, a retroreflection member placed at a back surface side of the lens to reflect the light passing through the lens back to its incoming direction, and an imaging optical system for imaging, from the front surface side of the lens, an image of the lens illuminated by the light reflected by the retroreflection member, so that a hidden mark, a progressive mark, or the like of a progressive focal lens can be imaged (see for example, EP1739472A1 (JP2005-316436)).

Such an apparatus using the screen would have problems in detection accuracy because the measurement index image is blurred due to roughness of the screen, and the mark point image, the small lens portion image of the bifocal lens, the mark image of the progressive focal lens, and others are projected in blurred and distorted states onto the screen due to refractive powers of the lenses.

Moreover, the apparatus arranged to illuminate the lens by the diffused illumination light from the back surface side of the lens could not easily detect (determine) an outer edge of the lens, a small lens portion edge of the bifocal lens, and others.

In the apparatus disclosed in EP 1739472A1 (JP2005-316436A), the optical system for detecting an optical center of the lens and others forms an optical path different from that of the optical system for imaging the lens image, resulting in a complicated apparatus configuration and a large sized apparatus.

BRIEF SUMMARY OF THE INVENTION

The present invention has an object to provide a cup attaching apparatus capable of accurately attaching a cup without complicated apparatus configuration.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the above object, the present invention provides a cup attaching apparatus for attaching a cup as a processing jig to an eyeglass lens, comprising: an illumination optical system comprising an illumination light source and arranged to illuminate the lens from a side of a front surface of the lens by illumination light from the light source; an imaging optical system comprising an imaging device and a retroreflection member placed on an opposite side from the light source with respect to the lens, the imaging optical system being adapted such that the retroreflection member returns the illumination light passing through the lens back to its incoming direction, and the imaging device receives the returned illumination light, and the imaging optical system being adjusted to focus on a point near a surface of the lens; an image processing device adapted to process an image signal from the imaging device to detect at least one of a mark point provided on a unifocal lens, a small lens portion of a bifocal lens, and a progressive mark provided on a progressive focal lens and obtain a position of the detected one; and an arithmetic control device adapted to determine an attaching position of the cup based on the position obtained by the image processing device.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

Figure 1:
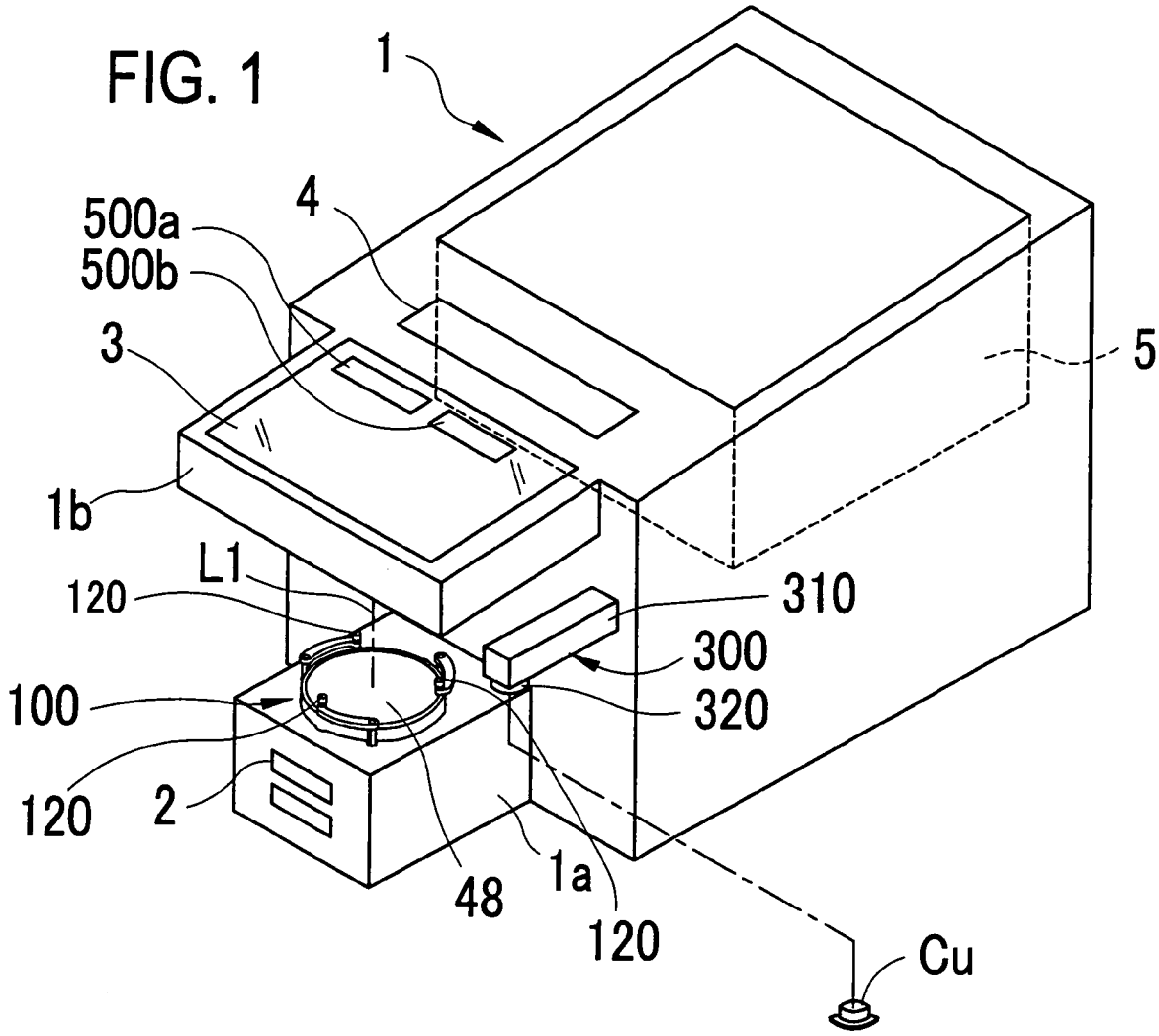
FIG. 1 is a schematic perspective view of a cup attaching apparatus of an embodiment of the invention.
Figure 2B:
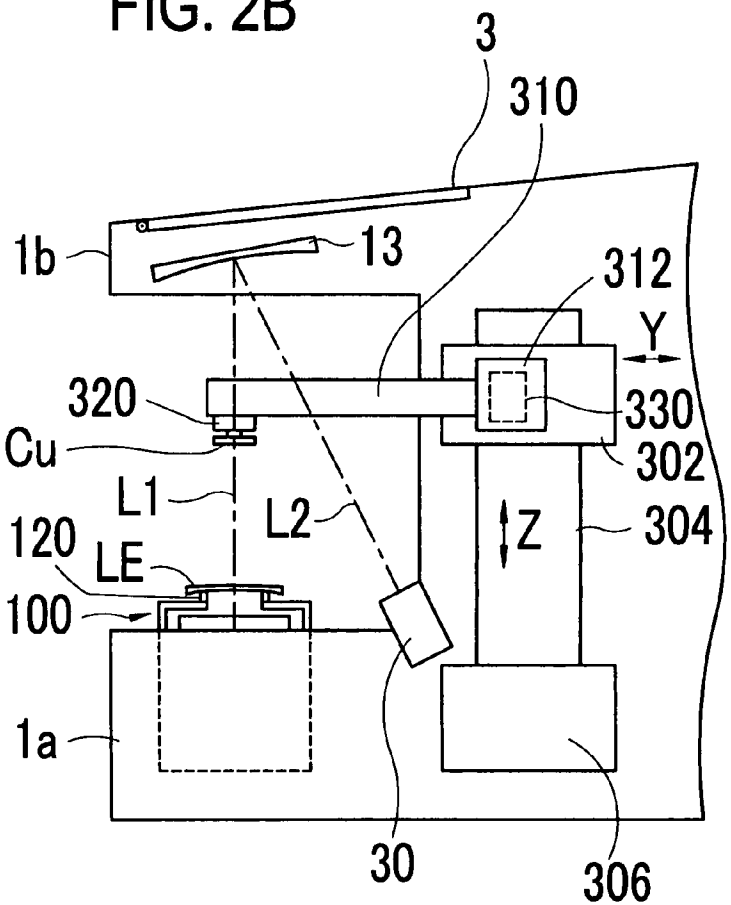
FIGS. 2A and 2B are schematic configuration views of partial inner structure of the apparatus.
Figure 2A:
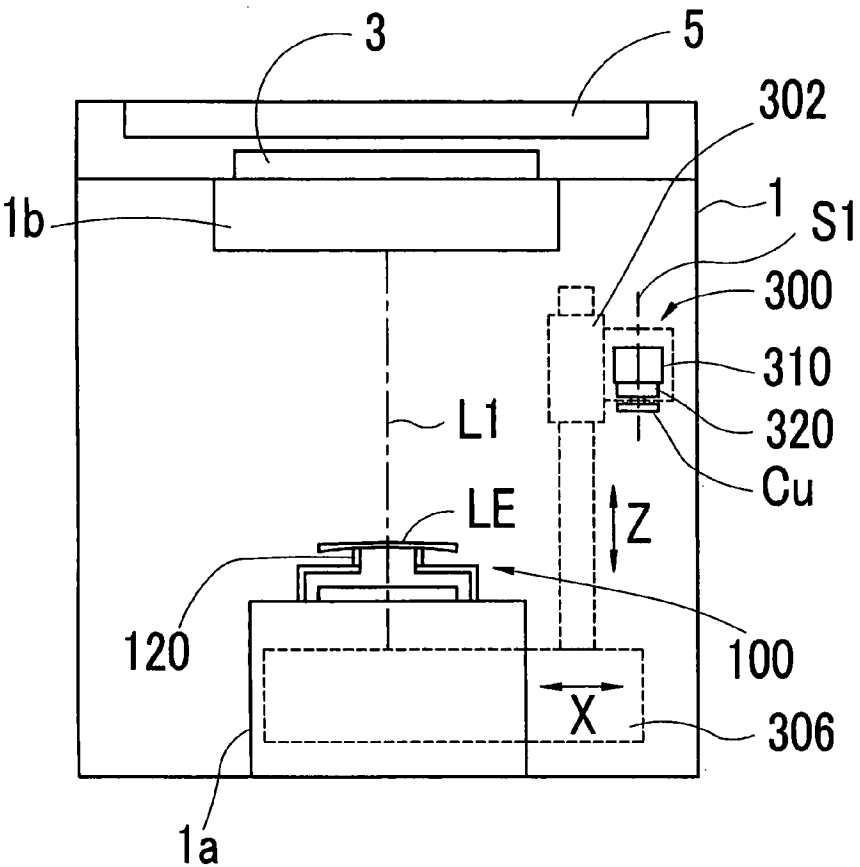

A detailed description of a preferred embodiment of the present invention will now be given referring to the accompanying drawings. FIG. 1 is a schematic perspective view of a cup attaching apparatus of this embodiment of the invention. FIGS. 2A and 2B are schematic configuration views of a partial inner structure of the apparatus; FIG. 2A is a front view of the apparatus and FIG. 2B is a side view thereof.

An apparatus main unit 1 has a laterally-facing U-shaped box form in a side view. In an upper portion of the main unit 1, an eyeglass frame measurement unit 5 is installed. In front thereof, an operation switch part 4 for the measurement unit 5 and a color display touch panel 3 are arranged. On a base part 1*a* extending forward from the main unit 1, a lens support mechanism 100 is placed, having three support pins 120 on which a lens LE is to be mounted. On a right portion of the main unit 1, a cup attaching mechanism 300 for attaching (fixing) a cup Cu to a front surface of the lens LE is placed. The cup attaching mechanism 300 comprises an arm 310 having a distal end provided with a mounting part 320 in which a base portion of the cup Cu is to be mounted. On the front of the base part 1*a*, an operation switch part 2 for the cup attaching mechanism 300 is arranged.

A concave mirror 13 is placed at a slant in a canopy part 1*b* extending forward from the main unit 1. In a place on an optical axis L2 provided when an optical axis L1 of light passing through the center of the lens support mechanism 100 is reflected by the concave mirror 13, an imaging optical system 30 including an imaging device for imaging an image of the lens LE is arranged.

<Cup Attaching Mechanism>

An explanation will be given of the configuration of the cup attaching mechanism 300 with reference to FIGS. 2A and 2B. The arm 310 holding the mounting part 320 is fixed to an arm holding base 312. This holding base 312 is supported to be movable forward and backward (in a Y-axis direction) relative to the main unit 1 by a Y-axis direction movement mechanism (a movement device) 302. This movement mechanism 302 is held to be movable upward and downward (in a Z-axis direction) by a Z-axis direction movement mechanism (a movement device) 304. This movement mechanism 304 is held to be movable rightward and leftward (in an X-axis direction) relative to the main unit 1 by an X-axis direction movement mechanism (a movement device) 306. Each of those movement mechanisms 302, 304, and 306 is constituted of a well known movement mechanism comprising a motor, a sliding mechanism, etc.

The mounting part 320 is held by the arm 310 to be rotatable about a center axis S1 (see FIG. 2A) of the cup Cu. A motor 330 for rotating the mounting part 320 is built in the arm holding base 312. In the arm 310, a rotation transmitting mechanism not shown is installed. Accordingly, the mounting part 320 is rotated about the center axis S1 by rotation of the motor 330, thereby changing a direction defining a cylinder axis of the cup Cu mounted in the mounting part 320.

<Lens Support Mechanism>

Figure 3A:
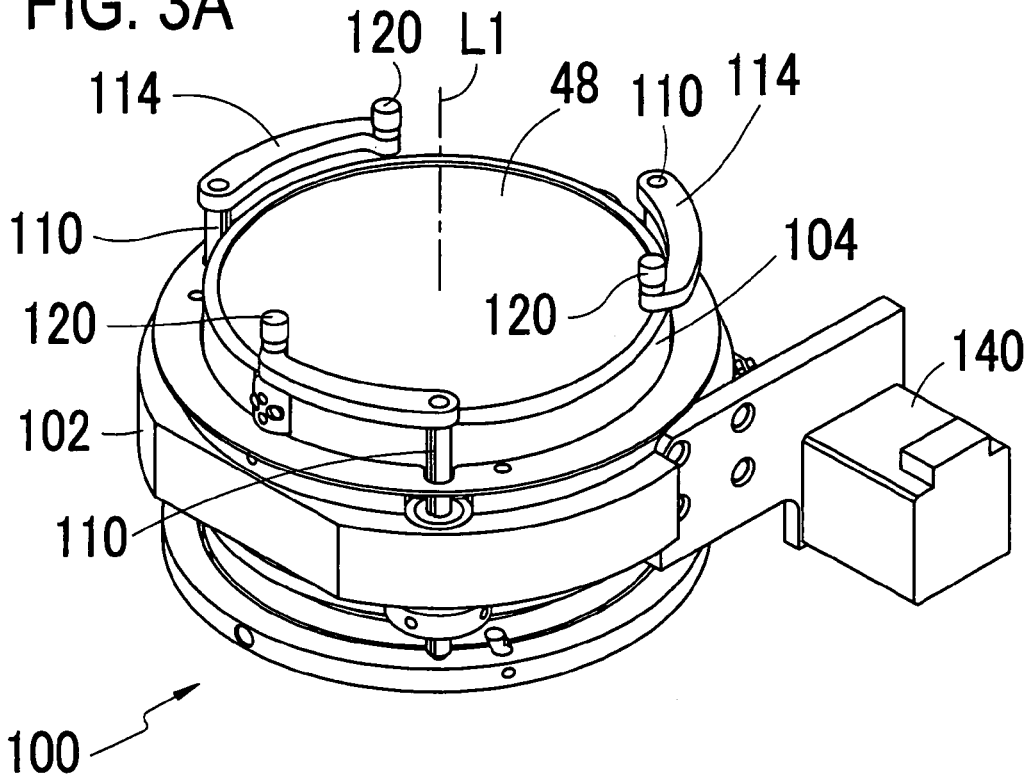
FIGS. 3A and 3B are schematic configuration views of a lens support mechanism.
Figure 3B:
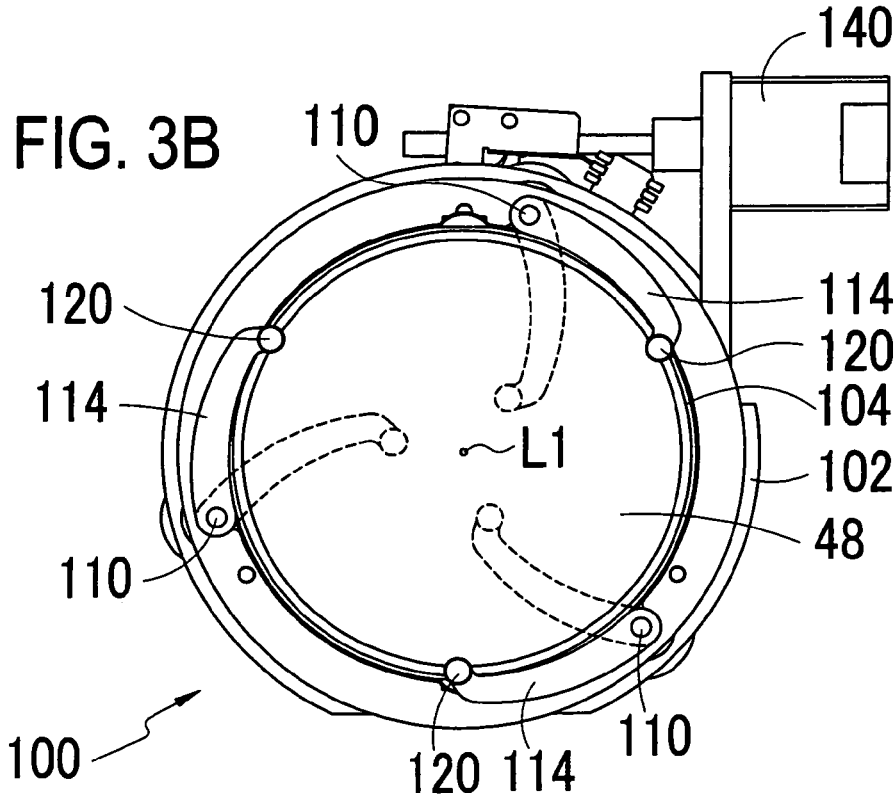

FIGS. 3A and 3B are schematic configuration views of the lens support mechanism 100. Inside a cylindrical base 102, a retroreflection member, a light receiving optical system, and others, which will be mentioned later, are placed. A transparent protective cover 48 is mounted on the top of the cylindrical base 102 by a ring member 104. The protective cover 48 is also used as a lens table. At three points around an outer periphery of the cylindrical base 102, rotating shafts 110 are rotatably supported respectively. An arm 114 is attached to an upper end of each rotating shaft 110 and provided at its distal end with the support pin 120. Three support pins 120 are arranged at an equal distance from the optical axis L1 and circumferentially spaced at equal angles (120° intervals). The lens LE is supported while a back surface of the lens LE is made contact with upper ends of the support pins 120. Rotation of a motor 140 is transmitted to each rotating shaft 110 through a rotation transmitting mechanism not shown. Each arm 114 is thus moved from a standby position shown in FIG. 3A to a support position shown by a dotted line in FIG. 3B. The distances from the support pins 120 to the optical axis L1 are changed simultaneously and hence the intervals between the support pins 120 are also changed. Thus, a dimension of an area to be supported by the support pins 120 to be changed.

In the above configuration, the arm 114 is moved by the motor 140. Alternatively, a rotation transmitting member such as a lever may be provided to allow movement of the arm 114 by hand.

<Optical System>

Figure 4A:
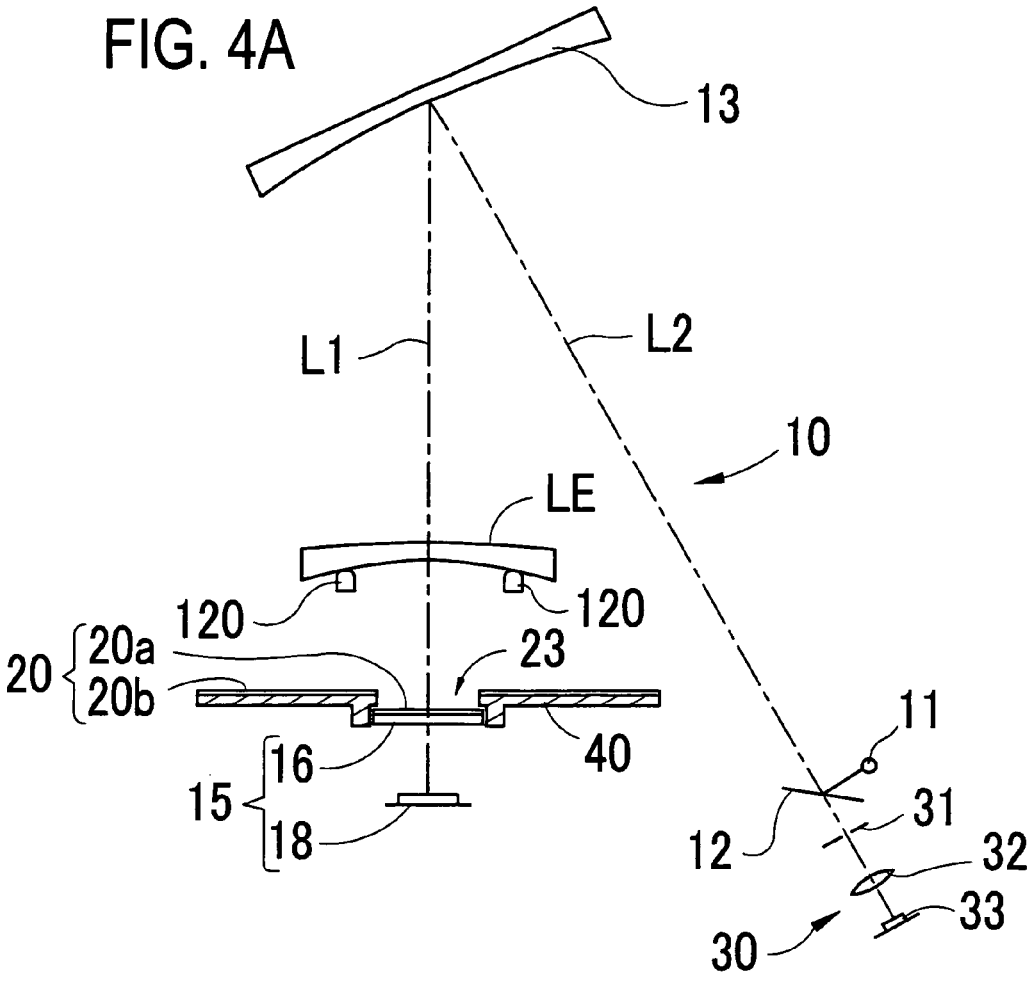
FIGS. 4A and 4B are schematic configuration views of an optical system.
Figure 4B:
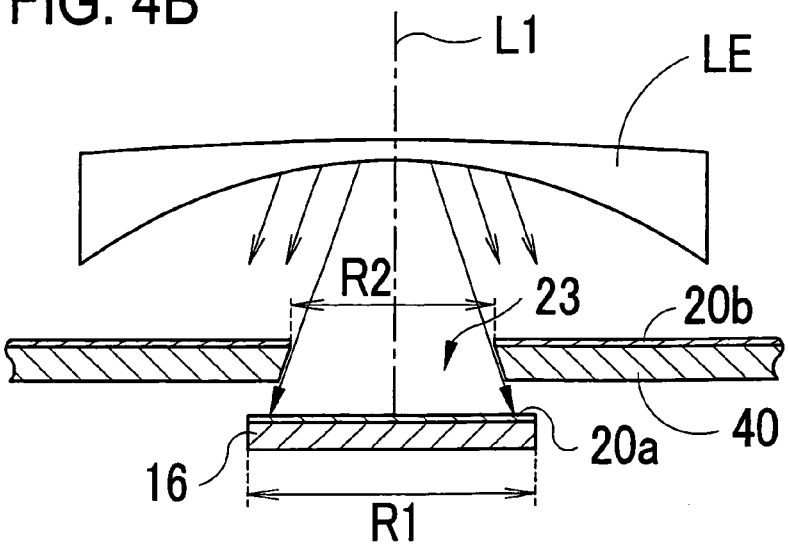

FIGS. 4A and 4B are schematic configuration views of an optical system of the apparatus. An illumination optical system 10 comprises an illumination light source 11 such as an LED which emits white light, a half mirror 12 placed on the optical axis L2, and the concave mirror 13 which reflects illumination light traveling from the light source 11 along the optical axis L2 toward the optical axis L1 and which shapes the light into nearly parallel light having a larger diameter than that of the lens LE placed on the optical axis L1. Onto the lens LE, the illumination light is projected from the front surface side of the lens LE by the illumination optical system 10. Instead of the concave mirror 13, a lens may be used as an optical member for shaping light into nearly parallel light having a larger diameter than that of the lens LE. However, the concave mirror 13 is preferable to avoid an increase in apparatus size.

Figure 5:
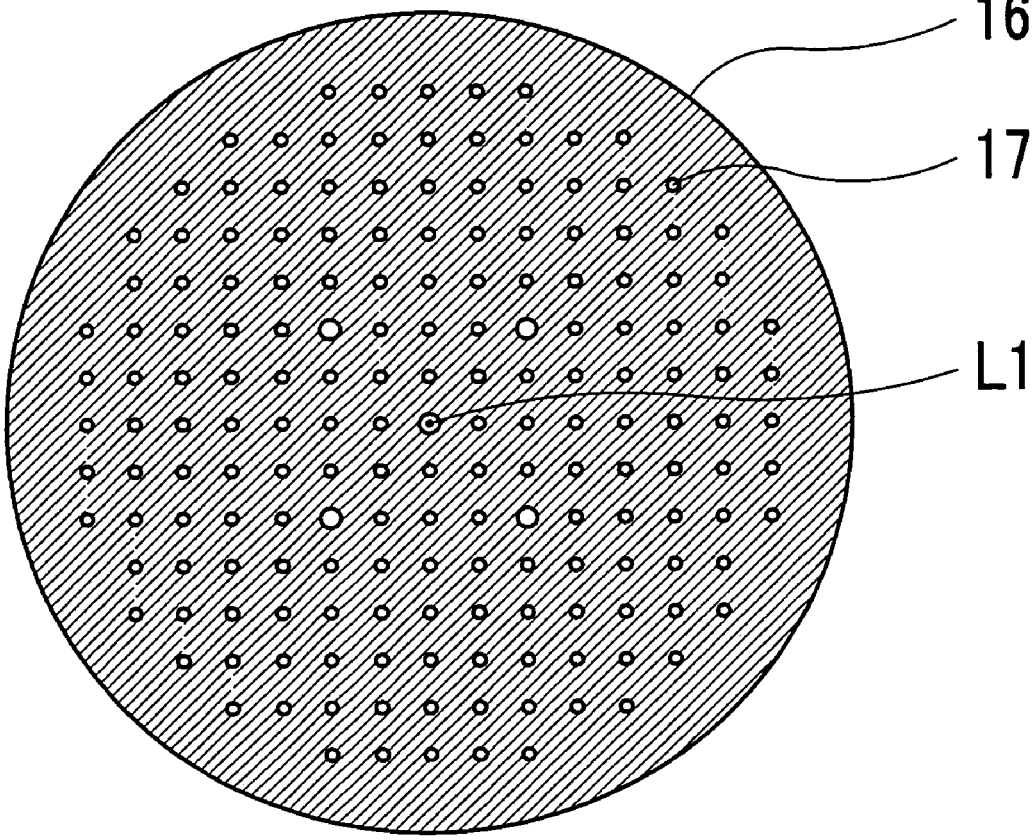
FIG. 5 is a view showing an aperture pattern of an index plate.

On the optical axis L1 behind the back surface of the lens LE, an index projection and light receiving optical system 15 is placed comprising an index plate 16 for detecting an optical center of the lens LE or the like and a two-dimensional photo-receiving element (an imaging device such as a CCD) 18 which receives the light passing through the index plate 16. As another configuration, the lens LE may be placed between the index plate 16 and the photo-receiving element 18. On the index plate 16, as shown in FIG. 5, a number of apertures (indices) 17 are geometrically arranged in a predetermined pattern. In this embodiment, circular apertures 17 each having a diameter of 0.2 mm are arranged in a lattice (grid) pattern. Of the apertures 17, a central aperture substantially corresponding to the optical axis L1 and four apertures positioned at four corners of 5×5 apertures arranged in square in the center are 0.3 mm in diameter different from other apertures. Accordingly, when aperture images received by the photo-receiving element 18 are deviated due to refraction power of the lens LE, a correspondence relation of the apertures 17 is distinguished. The index plate 16 is applied with chrome coating around each aperture 17 for light shielding. The shape of each aperture 17 is preferably circular, but not limited thereto, and it may be any shape if only it allows easy detection of the optical center and the cylinder axis angle of the lens LE. For example, each aperture 17 may be rectangular, linear, or the like. An interval between the apertures 17 is for example 0.8 mm.

The lens LE is illuminated by the illumination light of the illumination optical system 10. The illumination light having passed through the lens LE further passes through the apertures 17 of the index plate 16. Those aperture images are then received by the photo-receiving element 18, and the positions of the aperture images are detected.

Figure 6:
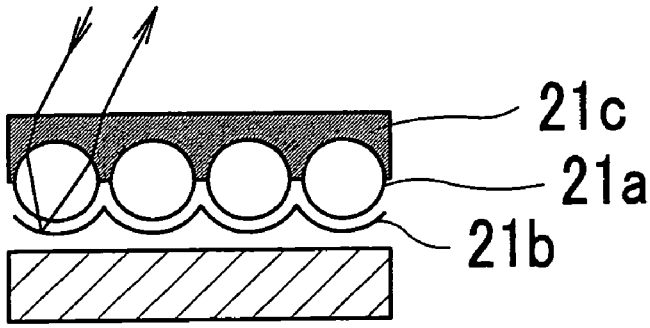
FIG. 6 is a view showing a configuration example of a retroreflection member.

A retroreflection member 20 for returning incident light to its incoming direction is placed between the lens LE and the index plate 16. The retroreflection member 20 reflects the illumination light passing through the lens LE back to the incident direction in the retroreflection member 20. The retroreflection member 20 in this embodiment comprises a circular, first retroreflection member 20*a* placed in the center through which the optical axis L1 passes and an annular, second retroreflection member 20*b* placed around the first retroreflection member 20*a*. The retroreflection member 20 is made of for example fine glass pellets 21*a*, a reflection film 21*b* placed under the pellets 21*a*, and a light-transmission cover 21*c* placed on the glass pellets 21*a* as shown in FIG. 6. This member 20 is formed as a sheet having a thickness of about 100 μm. Light passing through the cover 21*c* deflects in entering the glass pellet 21*a*, focuses on a point near a spherical surface of the glass pellet 21*a*, and is reflected by the reflection film 21*b*. The light reflected by the reflection film 21*b* deflects again in going out of the glass pellet 21*a* and is returned back to its incoming path in nearly parallel with incoming light. As this retroreflection member 20, a commercially available one can be used.

The first reflection member 20*a* is fixedly bonded over an upper surface of the index plate 16. On the other hand, the second reflection member 20*b* is bonded to a disk member 40 having a central opening 23 and rotated about the optical axis L1 by a rotation mechanism (a rotation device) mentioned later. In other words, the first reflection member 20*a* is fixedly placed on an optical path of the optical system 15 and the second reflection member 20*b* is rotatably placed surrounding the optical path of the optical system 15.

Figure 7:
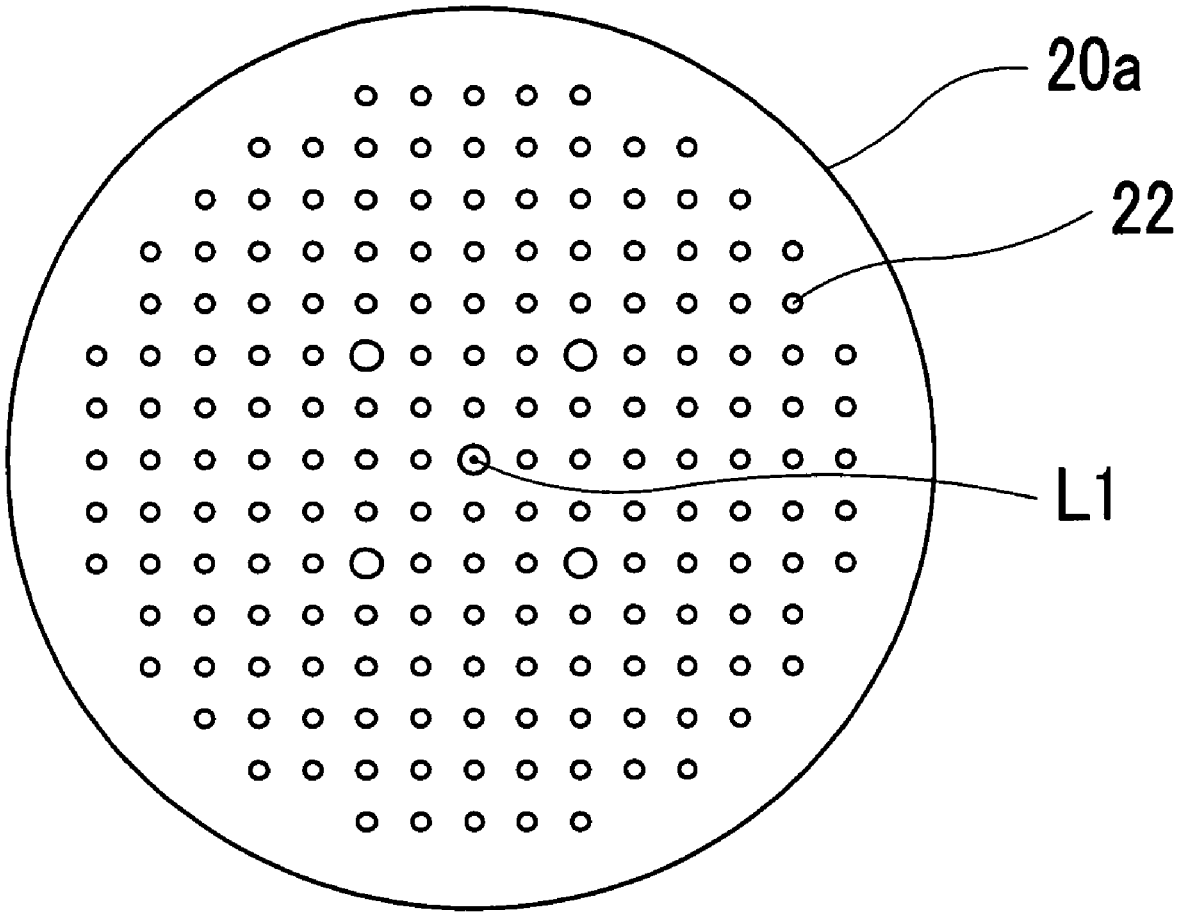
FIG. 7 is a view showing an aperture pattern of a first reflection member.

As shown in FIG. 7, the first reflection member 20*a* is formed with apertures 22 arranged in positions corresponding to the apertures 17 formed (arranged) in the index plate 16 to allow light to pass through the apertures 17. Each aperture 22 is formed to have a slightly larger diameter than that of each aperture 17 of the index plate 16. In this embodiment, each aperture 22 corresponding to the aperture 17 having a 0.2 mm diameter is 0.35 mm in diameter and each aperture 22 corresponding to the aperture 17 having a 0.3 mm diameter is 0.5 mm in diameter. The retroreflection member is also placed between the apertures 22 to minimize a missing reflection area of the illumination light.

The apertures 22 of the first reflection member 20 may be used directly instead of the apertures 17 of the index plate 16 so that the apertures 22 are also used as an index for detection of the optical center of the lens LE or the like. However, a commercially available retroreflection member is a sheet such as paper or cloth and therefore it is difficult to accurately make an edge of each aperture 22 into a predetermined form (a circle in this embodiment). Thus, the above configuration is preferable.

The imaging optical system 30 is placed on the front surface side of the lens LE to image the lens LE illuminated by reflection light from the retroreflection member 20. The imaging optical system 30 shares the concave mirror 13 with the illumination optical system 10 and comprises an aperture diaphragm 31, an imaging lens 32 and an imaging device 33 such as a CCD placed on a transmission side of the half mirror 12 on the optical axis L2. The aperture diaphragm 31 is disposed in a near focal position of the concave mirror 13 and in a position substantially conjugated with the light source 11. An imaging magnification of the imaging optical system 30 is set to a magnification at which an entire unprocessed lens LE is imaged by the imaging device 33. Further, a focal position of the imaging device 33 is adjusted to a point near the surface of the lens LE by an image-forming optical system of the imaging lens 32 and the concave mirror 13. Thus, a mark point marked on the surface of the lens LE, an edge of a small lens portion of a bifocal lens, a progressive mark of a progressive focal lens, and others are imaged in almost focus by the imaging device 33.

In this embodiment, the second reflection member 20*b* is placed closer to the lens LE relative to the position of the first reflection member 20*a* along the direction of the optical axis L1. The first reflection member 20*a* is designed to have a reflection surface with a diameter R1 greater than a diameter R2 of the opening 23 formed in the center of the second reflection member 20*b* and the disk member 40. The diameter R1 is determined to be so large as to allow incoming light on the front surface of the lens LE having most minus power to reach the reflection surface of the first reflection member 20*a* even when the light spreads due to the refraction power of the lens LE (see FIG. 4B). The light entering the first and second reflection members 20*a* and 20*b* is reflected back to its incoming direction by the characteristics of the retroreflection member. When the diameter R1 is larger than the diameter R2, the lens image imaged by the imaging device 33 on the front surface side of the lens LE is obtained as an image with no gap (shade) between the first and second reflection members 20*a* and 20*b*.

On the other hand, even when the first reflection member 20*a* is placed closer to the lens LE relative to the second reflection member 20*b*, the diameter R1 is determined to be larger than the diameter R2. In this case, the diameter R1 is set based on the same concept as above if assuming that the lens LE has most minus power.

It is to be noted that the first and second reflection members 20*a* and 20*b* may be arranged so that their reflection surfaces are flush with each other. In the case where the second reflection member 20*b* is configured to be rotatable, the reflection members 20*a* and 20*b* are preferably arranged so that their reflection surfaces partly overlap each other as shown in FIG. 4B. This is based on the following reason. If the reflection members 20*a* and 20*b* are arranged with their reflection surfaces being flush with each other and the second reflection member 20*b* is rotatable, a clearance has to be provided structurally between the first reflection member 20*a* and the opening 23 formed in the center of the second reflection member 20*b*. This clearance would cause reflection light loss, forming a circular shade in a lens image imaged by the imaging device 33. Such shade is liable to become an obstacle to detection of a mark point marked on the surface of the lens LE, an edge of a small lens portion of a bifocal lens, a progressive mark of a progressive focal lens, and others.

<Rotation Mechanism of Retroreflection Member>

In a commercially available retroreflection member, distributions of the glass pellets 21*a*, the reflection film 21*b*, and others are uneven between regions, resulting in reflection unevenness from region to another. Due to this reflection unevenness, an image imaged by the imaging device 33 causes deterioration in detection accuracy of a mark point marked on the surface of the lens LE, an edge of a small lens portion of a bifocal lens, a progressive mark of a progressive focal lens, and others. Therefore, a movement mechanism for moving the position of the reflection surface of the second reflection member 20*b* at high speeds relative to the optical axis L1 is provided to reduce the reflection unevenness imaged by the imaging device 33. This movement mechanism is preferably a simple configuration of rotating the second reflection member 20*b* about the optical axis L1 or its vicinity.

Figure 8:
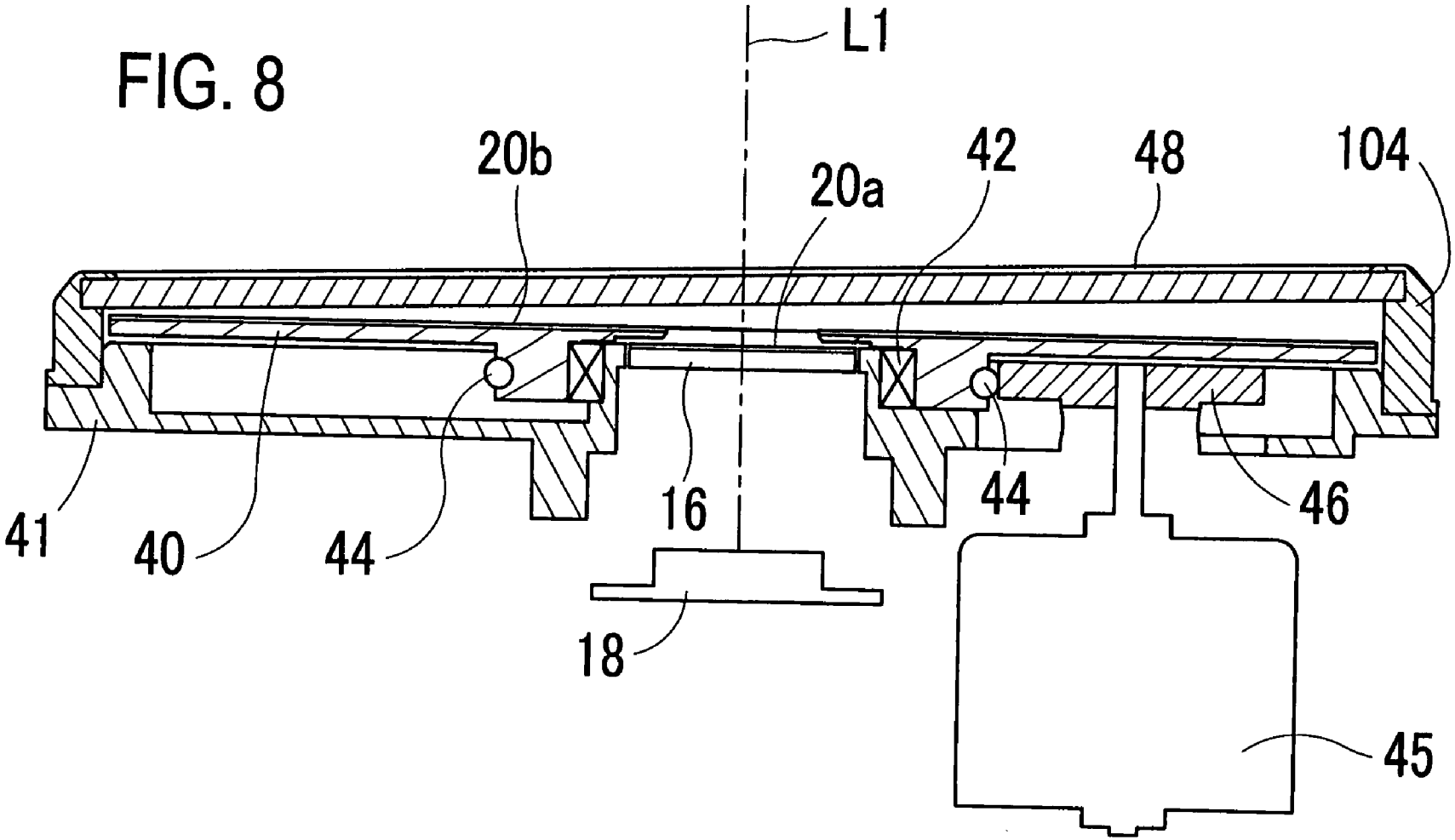
FIG. 8 is a schematic configuration view of a rotation mechanism of a second reflection member.

FIG. 8 is a schematic configuration view of a rotation mechanism (a rotation device) for rotating the second reflection member 20*b*. The disk member 40 bonded thereto with the second reflection member 20*b* is rotatably held on a holding base 41 through a bearing 42. The holding base 41 is fixed inside the cylindrical base 102. A rubber ring member 44 is fitted on a lower part of the disk member 40. A pulley 46 is fixed to a rotation shaft of a motor 45 fixed to the holding base 41. The pulley 46 is pressed against the rubber member 44. Accordingly, the rotation of the motor 45 is transmitted to the disk member 40 through the pulley 46 and the rubber member 44 to rotate the second reflection member 20*b* about the optical axis L1. The second reflection member 20*b* is preferably rotated at high speeds to rotate one turn or more for a time required to obtain a signal corresponding to one frame by the imaging device 33.

The index plate 16 bonded thereto with the first reflection member 20*a* is fixedly placed in the holding base 41. Above the first and second reflection members 20*a* and 20*b*, the protective cover 48 made of a transparent member is fixed by the annular member 104. The protective cover 48 is placed at a slant relative to the optical axis L1 to prevent regular reflection light of the illumination light projected from the front surface side of the lens LE from becoming noise light.

The movement mechanism for moving the position of the reflection surface of the second reflection member 20*b* at high speeds is not limited to the rotation mechanism and may be for example a mechanism for swinging sideways the reflection surface of the second reflection member 20*b* at high speeds. A movement amount thereof is preferably 5 mm or more. In this case, the diameter R1 of the first reflection member 20*a* is determined to be larger than a range of movement (lateral swinging) of the opening 23 with the diameter R2 of the second reflection member 20*b*.

<Control System>

Figure 9:
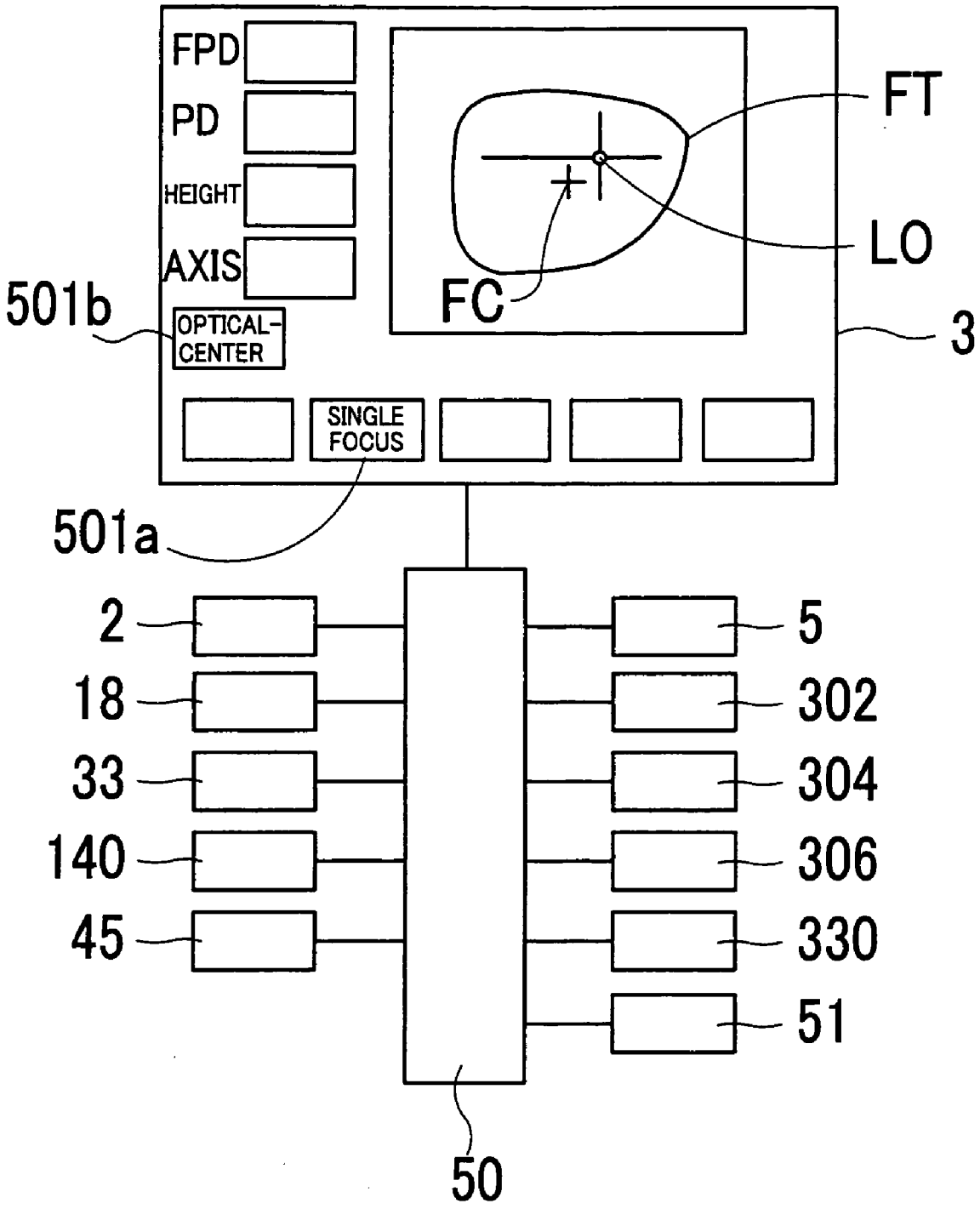
FIG. 9 is a schematic block diagram of a control system of the apparatus.

FIG. 9 is a schematic block diagram of a control system of the apparatus. Outputs of the photo-receiving element 18 and the imaging device 33 are inputted to a control part 50. The control part 50 has a function of performing image processing of the lens image imaged by the imaging device 33 and detecting the positions of a mark point marked on the surface of the lens LE, an edge of a small lens portion of a bifocal lens, a progressive mark of a progressive focal lens, an outer edge of the lens LE, and others, and therefore the control part 50 is also used as an image processing device. Further, the control part 50 also has a function of detecting the positions of the index images (aperture images) received by the photo-receiving element 18 and, based on this result, detecting the optical center of the lens LE, the cylinder axis angle of the lens LE, rough refractive power (spherical power S and cylinder power C) of the lens LE, and others, and therefore the control part 50 is also used as an arithmetic control device.

A brief description is given of detection of the optical center and the cylinder axis angle of the lens LE by the control part 50. With reference to the positions of aperture images received by the photo-receiving element 18 when the lens LE is not located on the optical axis L1 (or when a lens LE of 0 D is located on the optical axis L1), the light received position of each aperture image will change when the lens LE having refractive power is placed on the optical axis L1. The optical center of the lens LE is detected by determining the center of the positional change of the aperture images. When the lens LE has a cylinder axis angle, the cylinder axis angle is detected by determining the direction of the positional change of the aperture images. This detection method can adopt the same manner as disclosed in JP2002-292547A. The optical center and the cylinder axis angle of the lens LE can be detected in principle based on at least three index images (aperture images) in a similar manner to refractive characteristic measurement by a lens meter.

The control part 50 is connected to the movement mechanisms 302, 304, and 306 of the cup attaching mechanism 300, and the motors 330, 140, and 45. The control part 50 is further connected to the touch panel 3, the eyeglass frame measurement unit 5, the switch 2, and others.

Operations of the apparatus having the above structure will be explained below. Upon press of a mode selection button 500*a* appearing on an initial screen of the panel 3, a blocking mode is established and a layout entry screen is displayed to enable entry of layout data according to the type of a lens.

<Blocking to Unifocal Lens with No Mark Point>

Operations for attaching the cup Cu to a unifocal lens with no mark point are explained below. In this case, with a lens type selection key 501*a* appearing on the screen of the panel 3, an automatic mode for a unifocal lens (a mode for a unifocal lens with no mark point) is selected. On the panel 3, a screen appears for entry of a target lens shape data and layout data of a unifocal lens. The target lens shape data is obtained in such a manner that the shape (the target lens shape) of an eyeglass frame is measured by the eyeglass frame measurement unit 5 or the outer shape of a demo lens is measured by the imaging optical system 30 (an outer shape measurement mode for a demo lens mentioned later is used). The target lens shape data is stored in a memory 51 and a target lens shape figure FT is displayed on the screen of the panel 3 (the target lens shape data is inputted). Further, as an alternative, the target lens shape data previously stored in the memory 51 may be retrieved and inputted by operation of the panel 3. With a key appearing on the screen of the panel 3, layout data such as FPD (frame pupillary distance), PD (pupillary distance), and the height of an optical center LO with respect to a geometric center FC of the target lens shape are entered. In the case where the lens LE has a cylinder axis angle, cylinder axis angle data prescribed to a wearer is entered. With a cup attaching position selection key 501*b* appearing on this screen, as a mode for attaching position of the cup Cu to the lens LE, an optical center mode, a frame center (a geometric center of a target lens shape) mode, or an arbitrary (an arbitrary position) mode is set. On the panel 3, furthermore, processing conditions to be carried out in a lens edge processing device can also be entered.

Figure 10:
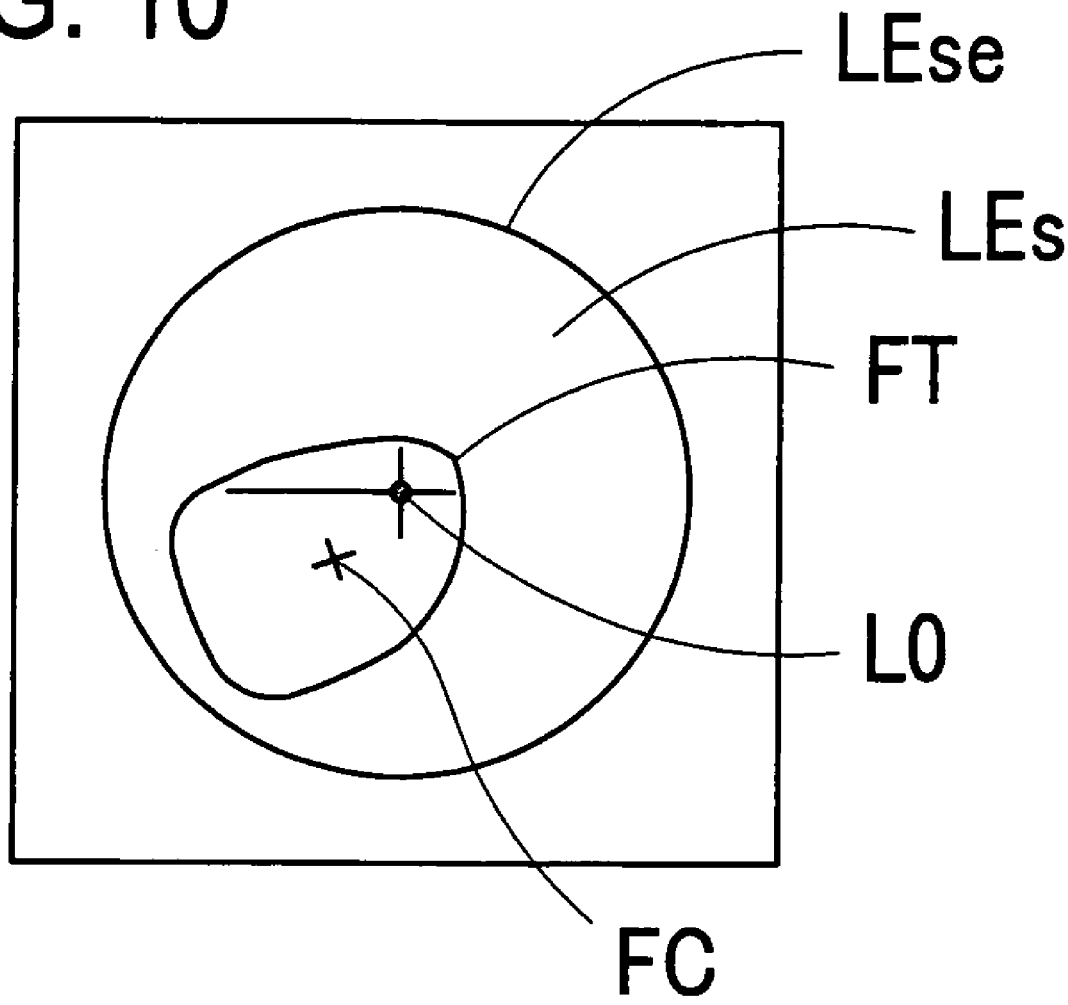
FIG. 10 is a view showing a relationship between a lens image, a target lens shape figure, and an optical center which are displayed.

When the lens LE is mounted on the support pins 120, the lens LE is illuminated by the illumination optical system 10 and the images of the apertures 17 of the index plate 16 are received by the photo-receiving element 18. Based on the positions of the aperture images received by the photo-receiving element 18, the optical center of the lens LE is detected by the control part 50. When the lens LE has a cylinder axis angle, the cylinder axis angle is detected as well as the optical center by the control part 50. On the screen of the panel 3, as shown in FIG. 10, a lens image LEs imaged by the imaging device 33 of the imaging optical system 30 is displayed and simultaneously the target lens shape figure FT is displayed in synthesized form. At that time, the display size and position of the target lens shape figure FT are determined by a detection result of the optical center LO, target lens shape data, layout data, a positional relationship of the optical axis of the optical system 30 relative to the optical axis of the optical system 15, an imaging magnification of the optical system 30, and others. When the target lens image LEs and the lens shape figure FT are to be synthesized and displayed on the screen of the panel 3, the position of the optical axis of the optical system 15 and the position of the optical axis of the optical system 30 are first made to coincide with each other on the screen and the display size of deviation of the optical center LO relative to the position of the optical axis L1 and the display size of the lens image LEs are made to coincide with each other. The display size of deviation of the optical center LO is determined by previously obtaining the distance per one pixel of the photo-receiving element 18. The display size of the lens image LEs is determined based on the imaging magnification of the optical system 30. The display size base of the target lens shape figure FT is made equal to the display size base of the lens image LEs. As to the display position of the target lens shape figure FT, a relationship between the optical center LO and the geometric center FC is determined by the layout data. In the case where the lens LE has a cylinder axis angle, the inclination angle of the target lens shape figure FT relative to the optical center LO is determined by a relationship between the detection result of the cylinder axis angle and the input cylinder axis angle. By checking whether the target lens shape figure FT extends beyond the outer line of the lens image LEs, it is determined whether or not the diameter of the lens LE is sufficiently larger than the target lens shape.

Figure 11A:
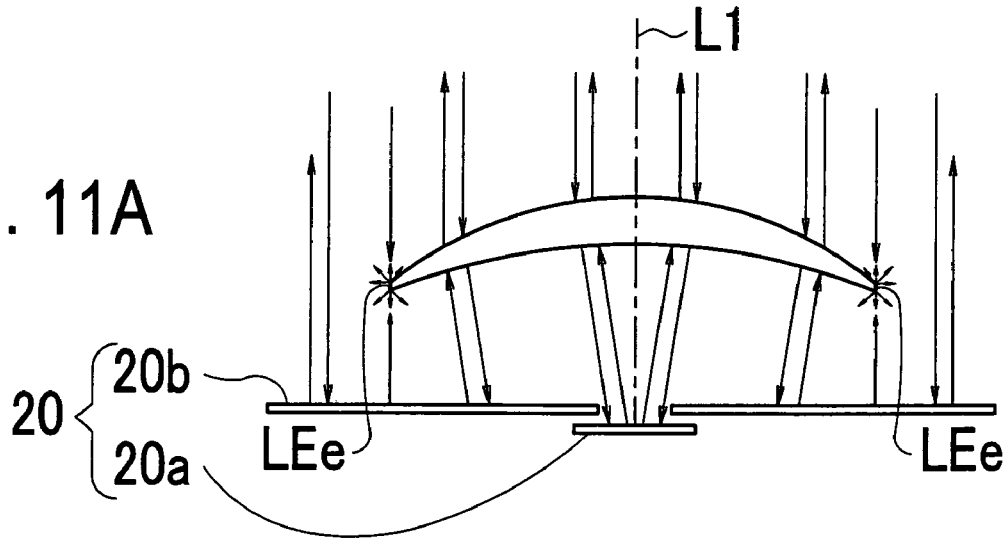
FIGS. 11A and 11B are views showing a state in which a lens outer edge is clearly detected and observed by the retroreflection member.
Figure 11B:
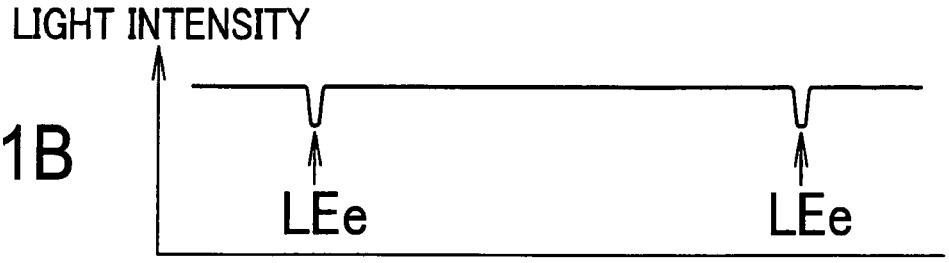

The lens image LEs imaged by the imaging device 33 is displayed with a clear outline because the lens LE is illuminated from the back surface side by the retroreflection member 20. As shown in FIG. 11A, the illumination light coming to the front surface of the lens LE passes through the outer portion and the inner portion of the lens LE and is returned back to its incoming direction by the retroreflection member 20, so that the lens LE is illuminated from the back surface side thereof. At that time, in a peripheral edge LEe of the lens LE, the illumination light coming to the front surface of the lens LE is scattered. The illumination light coming to the back surface of the lens LE reflected by the retroreflection member 20 is also scattered therein. The illumination light passing through the outer portion and the inner portion of the lens LE is returned back to its incoming direction by the retroreflection member without scattering. Therefore, the imaging device 33 adjusted to focus on a point near the surface of the lens LE receives an extremely decreased amount of light from the portion around the peripheral edge LEe as shown in FIG. 11B. Thus, an image of LEse of the peripheral edge LEe of the lens LE displayed on the screen of the panel 3 can be clearly observed.

For determination whether or not the diameter of the lens LE is sufficiently larger than the target lens shape, the control part 50 may be arranged to perform image processing and detect the lens image LEs (the peripheral edge image LEse) imaged by the imaging device 33 and automatically execute the determination based on the detection result and the placement of the target lens shape (determined by target lens shape data, layout data, the optical center, etc.). If the diameter of the lens LE is not sufficient, a warning message is displayed on the screen of the panel 3.

If the diameter of the lens LE is sufficiently large, the operation of attaching the cup Cu is started. In the frame center mode, upon press of a blocking switch on the switch part 2, the control part 50 drives the Y-axis direction movement mechanism 302 and the X-axis direction movement mechanism 306 to move the arm 310 so that the center axis S1 of the cup Cu is aligned with the geometric center FC of the target lens shape determined based on the detected optical center of the lens LE and the layout data. When the lens LE has the cylinder angle axis, the mounting part 320 is rotated about the center axis S1 based on the detected cylinder axis angle. After completion of the positional adjustment of the center of the cup Cu and the adjustment of the cylinder axis angle, the control part 50 drives the Z-axis direction movement mechanism 304 to move the arm 310 downward. Thus, the cup Cu is attached to the front surface of the lens LE. In the optical center mode, the position of the arm 310 is adjusted so that the center axis S1 of the cup Cu is aligned with the optical center LO of the lens LE.

<Blocking to Lens with a Mark Point>

Figure 12:
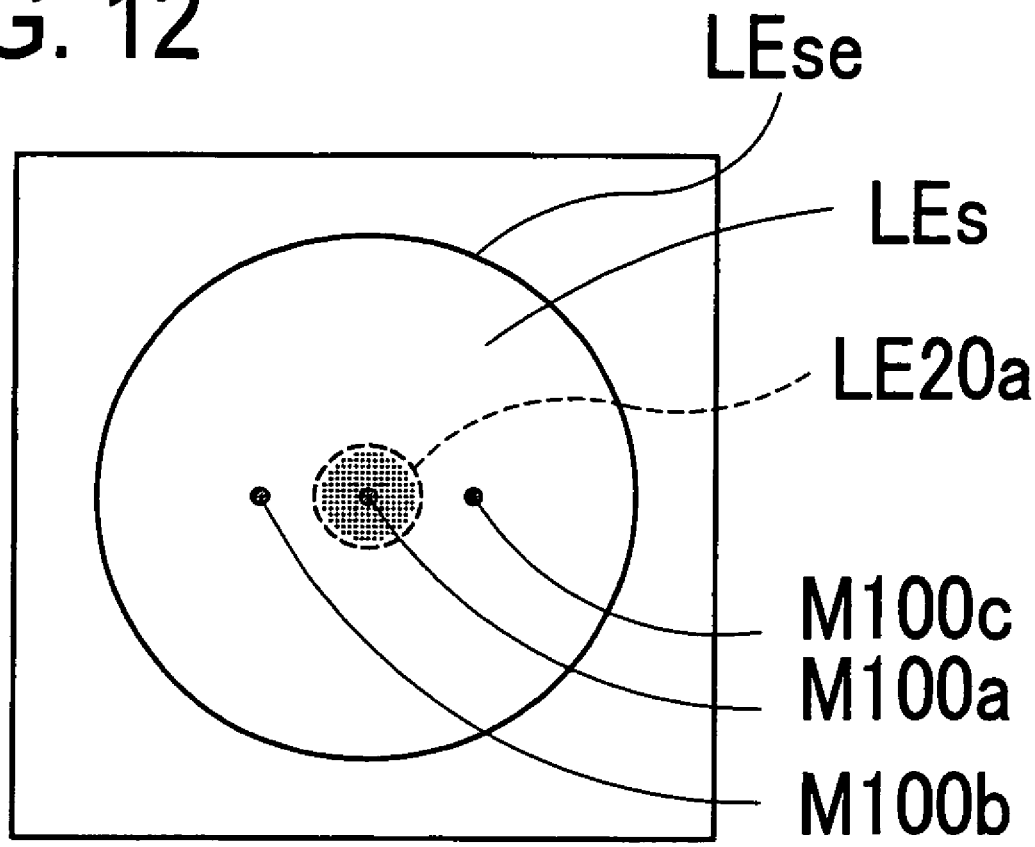
FIG. 12 is a view showing an example of a displayed image of a lens marked with a mark point.

The case where the lens LE such as a unifocal lens is marked with a mark point is explained below with a focus on operations different from the above. In this case, a mark point mode for a unifocal lens is selected with the lens type selection key 501*a*. The target lens shape data and the layout data are entered as in the above explanation. When the lens LE is mounted on the support pins 120, the lens LE is illuminated from the back surface side of the lens LE by the illumination light reflected by the retroreflection member 20, and the lens image is imaged by the imaging device 33 and displayed on the screen of the panel 3. FIG. 12 is a view showing an example of the screen provided at that time, in which three mark point images M100*a*, M100*b*, and M100*c* applied on the surface of the lens LE are displayed in the lens image LEs (the peripheral edge image LEse). The mark points applied on the surface of the lens LE are imaged from the front surface side of the lens LE by the imaging device 33 adjusted to focus on a point near the surface of the lens LE. Accordingly, the mark point images can be detected accurately without influence of the refractive power of the lens LE. The central mark point image M100*a* is an image of the mark point applied on the optical center of the lens LE by a lens meter. The control part 50 performs image processing of the lens image LEs to detect the mark point images M100*a*, M100*b*, and M100*c* and determine the center of each image.

The mark points applied on the surface of the lens LE does not allow the illumination light reflected by the retroreflection member 20 to pass therethrough. Accordingly, in the lens image LEs imaged by the imaging device 33, the mark point images are imaged with the extremely decreased light amount than the surrounding portion thereof In a region LE20*a* corresponding to the first reflection member 20*a*, aperture images corresponding to the apertures 22 of the first reflection member 20*a* are imaged, but the mark point image 100*a* is detected in distinction from the aperture images of the apertures 22 because each aperture 22 is formed with a sufficiently smaller diameter than the mark point (preferably, with a diameter smaller than half of the diameter of the mark point). Furthermore, the second reflection member 20*b* forming the outer peripheral part of the retroreflection member 20 is rotated at high speeds. In a region corresponding to the second reflection member 20*b* in FIG. 12, therefore, illumination unevenness is reduced and the mark point images M100*b* and M100*c* are accurately detected. In the region LE20*a*, illumination unevenness is somewhat found due to the first reflection member 20*a* fixedly placed. As to the mark point image M100*a*, however, its center, not outline, is detected, so that the image M100*a* is less influenced by the illumination unevenness. The center of the mark point image M100*a* is detected as a position with a lowest light amount in such a manner that luminance of the region including the center of the mark point image M100*a* and its surrounding portion is integrated in each of the x-axis coordinate and the y-axis coordinate.

When the center of the mark point image M100*a* provided in the optical center is detected, the position of the arm 310 is adjusted in the optical center mode so that the center axis S1 of the cup Cu is aligned with the center of the image M100*a*. In other words, the control part 50 determines the attaching position of the cup Cu based on the positional information of the image M100*a* to control movement of the arm 310 based on the attaching position. The cylinder axis angle is detected based on the mark point images M100*b* and M100*c* on both sides. Based on the detected cylinder axis angle, the mounting part 320 is rotated about the center axis S1. Thereafter, the movement mechanism 304 is driven to move the arm 310 downward and the cup Cu is attached to the front surface of the lens LE.

<Blocking to Bifocal Lens>

Figure 13:
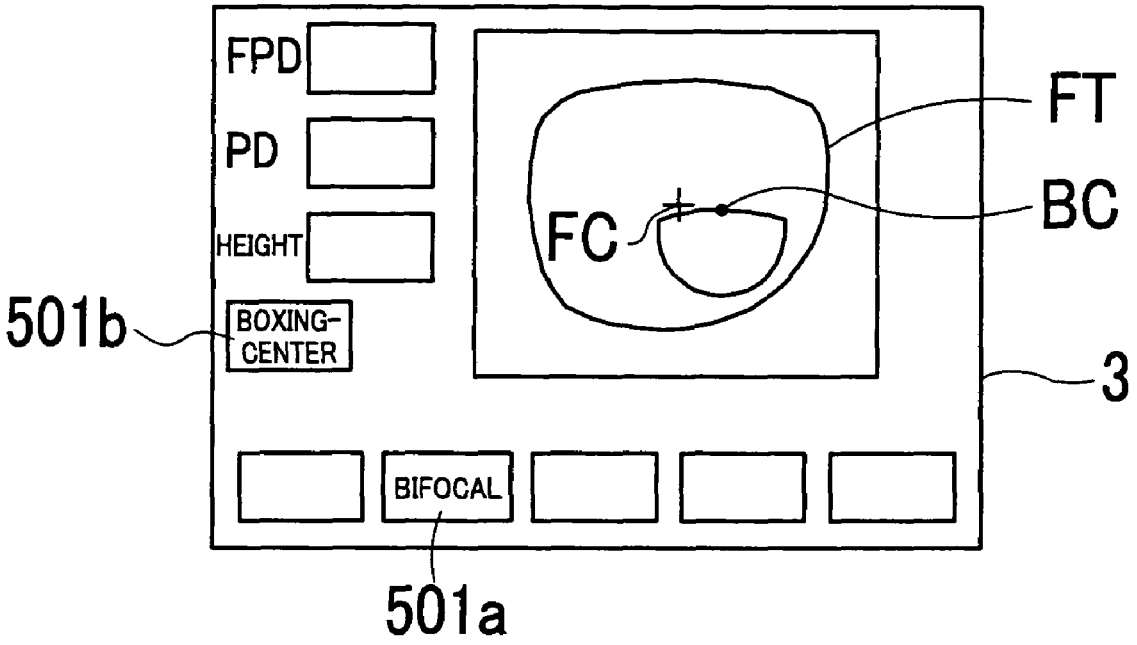
FIG. 13 is a view showing an example of an entry screen for layout data of a bifocal lens.

In the case of a bifocal lens, when the bifocal lens is selected with the lens type selection key 501*a*, a screen for entry of layout data of the bifocal lens with respect to the target lens shape appears on the panel 3. FIG. 13 is a view of an example of an entry screen for the layout data of the bifocal lens. The target lens shape data is inputted by measurement by the measurement unit 5 or retrieval from the memory 51. With a key appearing on the screen of the panel 3 on which a target lens shape figure FT is displayed based on the target lens shape data, FPD (frame pupillary distance) is entered. For the bifocal lens, the layout data is inputted with reference to a center point BC on an upper edge of a small lens portion. Further, a pupillary distance for near vision is entered as PD in a lateral direction, and a distance from the center point BC to a bottom side of the target lens shape directly below it or a distance from the lowermost point of the target lens shape to the center point BC is entered as the height. The frame center mode is established as a mode for an attaching position of the cup Cu.

Figure 14:
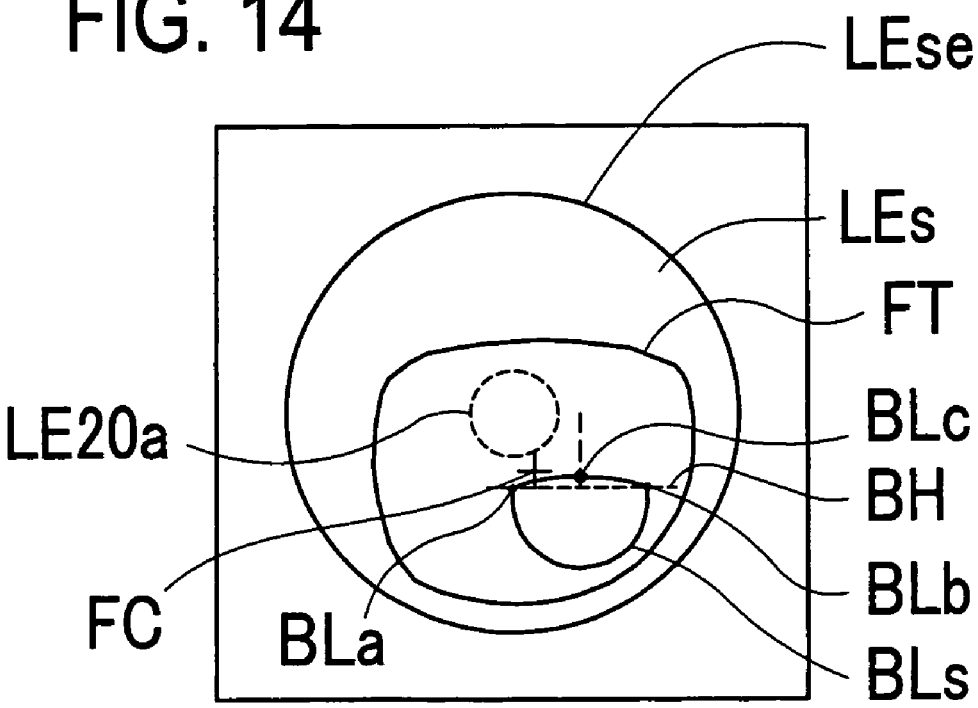
FIG. 14 is a view showing an example of a displayed image of a bifocal lens.

When the lens LE is mounted on the support pins 120, the lens image imaged by the imaging device 33 is displayed on the screen of the panel 3. FIG. 14 is a view showing an example of the screen appearing at that time, on which a small lens portion image (a small lens portion edge image) BLs is displayed in the lens image LEs (the peripheral edge image LEse). In the small lens portion edge of the bifocal lens, as with the case shown in FIG. 11, the illumination light coming to the front surface of the lens LE is scattered and the illumination light coming to the back surface of the lens LE reflected by the retroreflection member 20 is also scattered. The illumination light passing through the lens portion other than the small lens portion edge is returned back to its incoming direction by the retroreflection member 20 without scattering. Thus, the light amount of the small lens portion edge is greatly decreased than other lens portions. This makes it possible to clearly observe the small lens portion image BLs appearing on the panel 3. This is also imaged by the imaging device 33 as an image with no distortion resulting from the refraction power of the lens LE. Accordingly, the position of the small lens portion image BLs can be detected accurately.

The control part 50 performs image processing of the lens image LEs imaged by the imaging device 33*a* to detect the small lens portion image BLs and detect an outline position thereof. From a line BH joining a left end point BLa and a right end point BLb of the small lens portion image BLs, the inclination of the lens LE (an angle in a rotating direction) is detected. The position of a base point BLc located on the perpendicular bisector of the line BH and on the upper edge of the small lens portion is then detected. The display position and the display size of the target lens shape figure FT are determined based on the position of the detected base point BLc, the target lens shape data, the layout data, the imaging magnification of the optical system 30, and others. The target lens shape figure FT is thus synthesized with the lens image LEs and displayed. Based on observation of the positional relationship between the target lens shape figure FT and the peripheral edge image LEse, it is determined whether or not the diameter of the lens LE is sufficiently larger than the target lens shape.

Preferably, when the lens LE is mounted on the support pins 120, the small lens portion image BLs goes away from the region LE20*a* corresponding to the first reflection member 20*a* and is disposed above the second reflection member 20*b* which will be rotated at high speeds by the motor 45. In the case where the second reflection member 20*b* is not rotated, reflection unevenness occurs on the reflection surface of the retroreflection member 20 and will cause noise in detection of the small lens portion image BLs. When the second reflection member 20*b* is rotated at high speeds, on the other hand, the reflection unevenness is reduced and the position of the small lens portion image BLs can be detected accurately. To prevent the small lens portion image BLs from greatly deviating from the imaging range of the imaging device 33 and the second reflection member 20*b*, the diameter R2 of the opening 23 of the second reflection member 20*b* (the diameter R1 of the first reflection member 20*a* when this reflection member 20*a* is located closer to the lens LE) is preferably 20 mm or less and more preferably 15 mm or less.

In the frame center mode, the position of the geometric center FC of the target lens shape is determined based on the detection result of the base point BLc and the input layout data. When the blocking switch is pressed, the position of the arm 310 is adjusted so that the center axis S1 of the cup Cu is aligned with the determined geometric center FC. Specifically, the control part 50 determines the attaching position of the cup Cu based on the positional information of the base point BLc and controls movement of the arm 310 based on the attaching position. The mounting part 320 is rotated about the center axis S1 based on the axis angle determined from the left end point BLa and the right end point BLb. Thereafter, the movement mechanism 304 is driven to move the arm 310 downward, and the cup Cu is attached to the front surface of the lens LE.

<Blocking to Progressive Focal Lens>

When the cup Cu is to be attached with reference to a progressive mark printed on the surface of a progressive focal lens, the progressive focal lens is selected with the lens type selection key 501*a*, and then the panel 3 displays a screen for entry of layout data to layout the position of a far-vision eyepoint of the progressive focal lens with respect to the target lens shape. Entry of the target lens shape data and the layout data is basically performed in a similar manner as above. The optical center mode is set as a mode for attaching position of the cup Cu.

Figure 15:
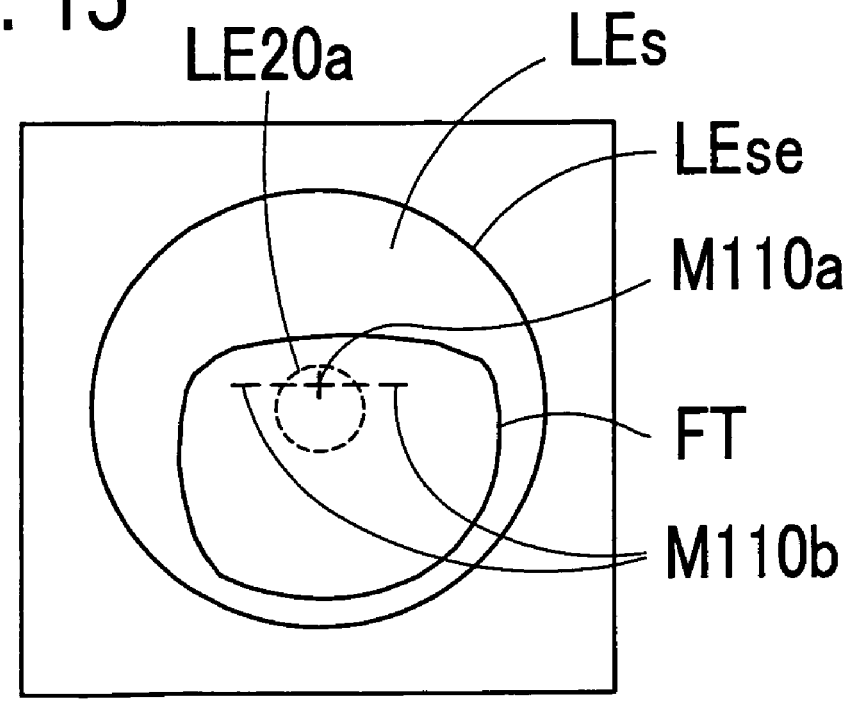
FIG. 15 is a view showing an example of a displayed image of a progressive focal lens.

When the progressive focal lens is mounted on the support pins 120, the lens image imaged by the imaging device 33 is displayed on the screen of the panel 3. FIG. 15 is a view showing an example of the screen appearing at that time, on which a cross mark image M110*a* indicating an far-vision eyepoint and a horizontal mark image M110*b* indicating a horizontal level are displayed in the lens image LEs (the peripheral edge image LEse). In this case, the cross mark image M110*a* is subjected to image processing and its center is detected. Further, the horizontal mark image M110*b* is subjected to image processing and a horizontal angle of the progressive focal lens is detected. Since a focal point of the imaging optical system 30 is adjusted to near the surface of the lens LE, those progressive mark images can be detected accurately. The second reflection member 20*b* is rotated at high speeds and thus the reflection unevenness of the reflection surface of the retroreflection member 20 is reduced, so that the mark image located outside the region LE20*a* corresponding to the first reflection member 20*a* can be detected more accurately. Moreover, even in the case of the mark image located within the corresponding region LE20*a*, the center of the mark image has only to be detected, differently from the detection of the small lens portion edge of the bifocal lens. For instance, in the case of the cross mark image M110*a*, a point with a lowest light amount is determined as the center in each of the x-axis coordinate direction and y-axis coordinate direction. Thus, the influence of noise caused by reflection unevenness and loss of the apertures 22 is reduced and the center of the mark image can be detected accurately. A line width of the progressive mark is about 0.5 mm to about 0.8 mm. To facilitate distinction between those marks and the apertures 22, each aperture 22 is preferably formed to be smaller in diameter (in this embodiment, 0.3 mm or less) as compared with the line width of the progressive mark.

As to the target lens shape figure FT, as with the case of the bifocal lens, the display size and the display position are determined based on the target lens shape data, layout data, imaging magnification of the optical system 30, and others. Based on observation of a positional relationship between the target lens shape figure FT and the peripheral edge image LEse, it is determined whether or not the diameter of the lens LE is sufficiently larger than the target lens shape.

For attachment of the cup Cu, the position of the center axis S1 of the cup Cu is adjusted based on the detection position of the cross mark image M110*a*, and the horizontal rotation angle of the cup Cu is adjusted based on the detection angle of the horizontal mark image M110*b*. Specifically, the control part 50 obtains the attaching position of the cup Cu based on the positional information of the cross mark image M110*a* and the horizontal mark image M110*b*, movement of the arm 310 is controlled based on the attaching position.

<Measurement of Outer Shape (Lens Shape) of Demo Lens>

The apparatus has the function of measuring an outer shape (lens shape) and positions of holes of a demo lens (including a template) for a so-called two point frame by utilizing the illumination optical system 10 for illuminating the lens LE by the illumination light with a diameter larger than the that of lens LE from the front surface side of the lens LE; the retroreflection member 20 which returns the illumination light passing through the lens LE back to the incoming direction; the imaging optical system 30 for imaging the lens LE from the front surface side of the lens LE.

Operations for measuring the outer shape and the hole positions of the demo lens will be explained below. When a mode selection button 500*b* appearing on the initial screen of the panel 3 is pressed, an outer shape measurement mode is established. In this mode, if the support pins 120 and the arms 114 are in a measurement area of the demo lens outer shape, they are liable to interrupt measurement. Accordingly, the arms 114 are rotated by the motor 140 to move the support pins 120 from the positions above the protective cover 48 to respective standby positions.

Figure 16:
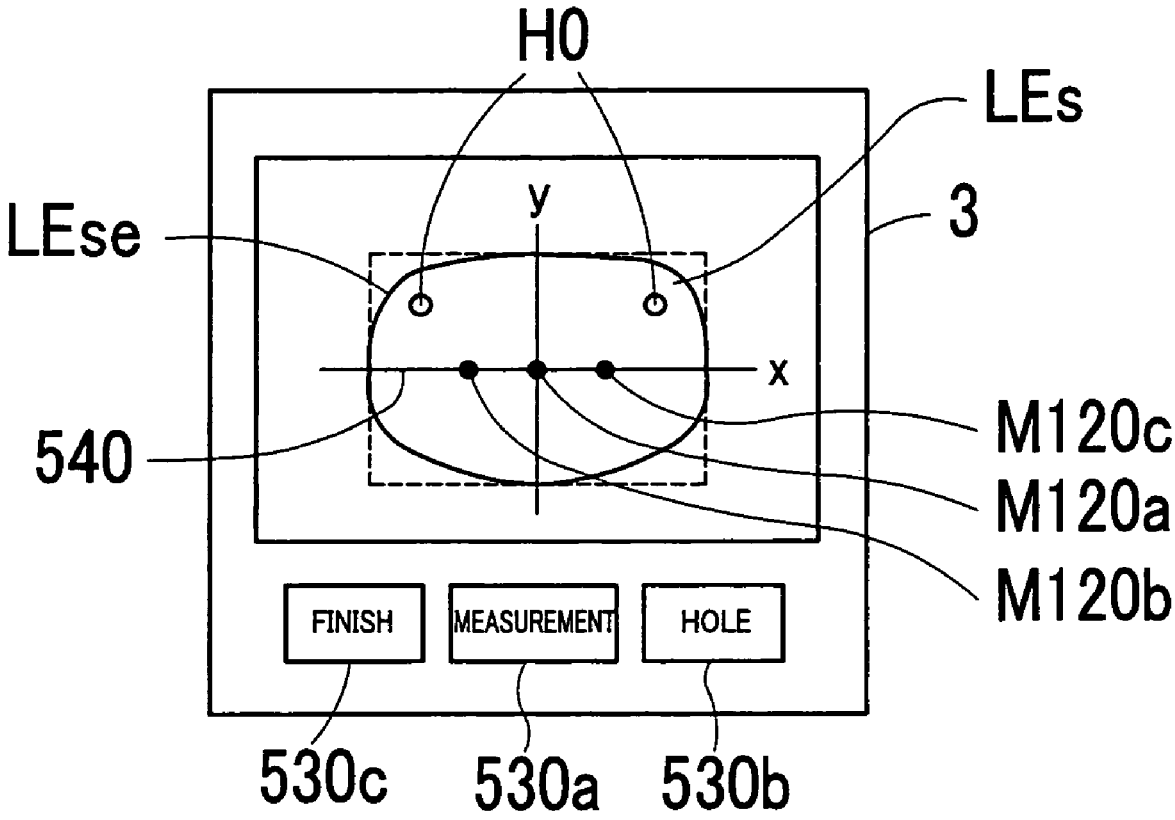
FIG. 16 is a view showing an example of a measurement screen for an outer shape of a demo lens.

When the outer shape measurement mode is selected, the screen of the panel 3 is switched to a measurement screen shown in FIG. 16. The demo lens mounted on the protective cover 48 is illuminated from the back surface side of the lens by the illumination light reflected by the retroreflection member 20. An image thereof is imaged by the imaging device 33. The aperture of the aperture diaphragm 31 is made small to deepen the depth of field so that light also nearly focuses on the demo lens mounted on the protective cover 48. The aperture diaphragm 31 is placed near the focal point of the concave mirror 13 to constitutes a telecentric optical system. Accordingly, the influence from the difference in the position of the demo lens along the optical axis L1 will be reduced. The outer size can be detected accurately. The demo lens image LEs imaged by the imaging device 33 is displayed on the screen of the panel 3.

When a measurement button 530*a* is pressed on the measurement screen shown in FIG. 16, the measurement of the outer shape and hole positions of the demo lens LE is started based on the image imaged by the imaging device 33. At this time, the peripheral edge LEe and the holes of the demo lens LE are illuminated from the back surface side of the lens LE by the retroreflection member 20. Similar to FIG. 11, the light amount is decreased in the peripheral edge LEe and the edge of each hole. Thus, the peripheral edge LEe and the outline of each hole can be detected clearly. Since the second reflection member 20*b* is rotated, furthermore, illumination unevenness of the retroreflection member 20 is reduced and the outlines of the peripheral edge LEe and the holes can be detected precisely.

The imaging magnification of the optical system 30 with respect to the protective cover 48 has been well known in design. The outer shape of the demo lens LE is obtained by image processing and detecting contrast of the image imaged by the imaging device 33. Further, the geometric center FC is determined from the outer shape, and the center of each hole is obtained relative to the geometric center FC.

The demo lens LE is provided in advance with three mark points indicating the horizontal direction by the lens meter. While observing the lens image LEs on the screen, the inclination of the lens LE is adjusted so that three mark point images M120*a*, M120*b*, and M120*c* are located on an x-axis line 540, thereby setting the horizontal direction for outer shape measurement.

When the hole diameter and the hole position are to be set in detail, an operator touches and selects either one of hole images H0 and then presses a hole setting button 530*b*. An enlarged screen is displayed to allow correction of the hole diameter and the hole position. Upon press of a finish button 530*c*, the outer shape data and the hole data are stored in the memory 51. The outer shape data and others stored in the memory 51 are retrieved and used when the cup Cu is to be attached. Furthermore, they are outputted to a hole making machine connected to the control part 50.

In the above explanation, the cup attaching mechanism 300 including as the arm 310, the mounting part 320, and others is moved to adjust the attaching position of the cup Cu. Alternatively, a lens support mechanism including the support pins 120 and others may be moved to adjust the attaching position of the cup Cu. Instead of movement of the lens support mechanism or the cup attaching mechanism, it may be arranged to display detection information of the optical center and the cylinder axis angle of the lens LE on the screen of the panel 3 and the lens LE may be moved by hand to adjust the attaching position of the cup Cu, as disclosed in U.S. Pat. No. 6,798,501B1 (JP2000-79545).

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A cup attaching apparatus for attaching a cup as a processing jig to an eyeglass lens, comprising:

an illumination optical system comprising an illumination light source and arranged to illuminate the lens from a side of a front surface of the lens by illumination light from the light source;

an imaging optical system comprising an imaging device and a retroreflection member placed on an opposite side from the light source with respect to the lens, the imaging optical system being adapted such that the retroreflection member returns the illumination light passing through the lens back to its incoming direction, and the imaging device receives the returned illumination light, and the imaging optical system being adjusted to focus on a point near a surface of the lens;

an image processing device adapted to process an image signal from the imaging device to detect at least one of a mark point provided on a unifocal lens, a small lens portion of a bifocal lens, and a progressive mark provided on a progressive focal lens and obtain a position of the detected one;

an arithmetic control device adapted to determine an attaching position of the cup based on the position obtained by the image processing device; and an index projection and light receiving optical system comprising an index plate formed thereon with a predetermined pattern and a two-dimensional photo-receiving element which receives measurement light passing through the index plate and the lens and has a light receiving surface on which an image of the pattern is to be formed, wherein the arithmetic control device is arranged to determine optical characteristics of the lens based on output from the photo-receiving element, and the retroreflection member includes a first retroreflection member placed on an optical path of the index projection and light receiving optical system and a second retroreflection member placed surrounding the optical path.

2. The cup attaching apparatus according to claim 1, further comprising a rotation device arranged to rotate the second retroreflection member about an optical axis of the index projection and light receiving optical system at a speed for one turn or more within a time required to obtain a signal corresponding to one frame.

3. The cup attaching apparatus according to claim 1, wherein the first retroreflection member has a light transmittance part that matches the pattern of the index plate, and the first retroreflection member is bonded on the index plate.

4. The cup attaching apparatus according to claim 1, further comprising:

a lens type selection key for selecting a lens type from a unifocal lens with no mark point, a unifocal lens with a mark point, a bifocal lens, and a progressive focal lens.

5. The cup attaching apparatus according to claim 1, further comprising:

an input device for entering layout data including a frame pupillary distance and a pupillary distance.

6. The cup attaching apparatus according to claim 1 further comprising:

an input device for entering layout data of one of a bifocal lens and a progressive focal lens.

7. The cup attaching apparatus according to claim 1 further comprising:

a movement device arranged to move an arm holding a cup mounting part, relative to the lens, based on the attaching position determined by the arithmetic control device.

8. The cup attaching apparatus according to claim 1, wherein the imaging optical system comprises an aperture diaphragm placed in a position substantially conjugated with the light source.

* * * * *